United States Patent [19]

Ayler et al.

[11] 4,160,405

[45] Jul. 10, 1979

[54] LIQUID PROPELLANT GUN, POSITIVE DISPLACEMENT SINGLE VALVE

[75] Inventors: Steven E. Ayler, China Lake; John W. Holtrop, Ridgecrest, both of Calif.

[73] Assignee: The United States of America as represented by the Secretary of the Navy, Washington, D.C.

[21] Appl. No.: 879,555

[22] Filed: Feb. 21, 1978

[51] Int. Cl.[2] ..... F41F 1/04

[52] U.S. Cl. ..... 89/7; 89/11

[58] Field of Search ..... 89/7, 11

[56] References Cited

U.S. PATENT DOCUMENTS

| | | | |
|---|---|---|---|
| 3,138,990 | 6/1964 | Jukes et al. | 89/7 |
| 3,160,064 | 12/1964 | Bell et al. | 89/7 X |
| 3,380,345 | 4/1968 | Nelson | 89/7 |
| 3,455,202 | 7/1969 | Dixon et al. | 89/7 |
| 3,521,523 | 7/1970 | Van Langenhoven | 89/7 |
| 3,803,975 | 4/1974 | Elmore et al. | 89/7 |
| 3,915,057 | 10/1975 | Broxholm et al. | 89/7 |
| 3,992,976 | 11/1976 | Bartels et al. | 89/7 |
| 4,033,224 | 7/1977 | Holtrop | 89/7 |
| 4,050,352 | 9/1977 | Tassie | 89/7 |
| 4,091,711 | 5/1978 | Petersen et al. | 89/7 |

*Primary Examiner*—David H. Brown

*Attorney, Agent, or Firm*—R. S. Sciascia; W. Thom Skeer

[57] ABSTRACT

An improved bi-propellant injection system for a liquid propellant gun including a valve which is positively opened at the start of the injection of the fuel and oxidizer into the gun chamber and held at a predetermined displacement to provide a constant size propellant orifice throughout the fuel and oxidizer injection cycle.

10 Claims, 2 Drawing Figures

LIQUID PROPELLENT GUN, POSITIVE DISPLACEMENT SINGLE VALVE

BACKGROUND OF THE INVENTION

1. Field of the Invention

The strong influence of propellant mixing on liquid propellant gun interior ballistics has been recognized and studied. A measuring technique to determine the degree of mixing has been developed and indicates that gun performance can be varied from misfires through normal burns to detonation simply by varying the severity of the injection. This knowledge has underscored the need for better control of the injection process in the liquid propellant gun technology.

2. Description of the Prior Art

In present bi-propellant liquid propellant guns, the displacement of the valves during injection of the fuel and oxidizer into the chamber of the gun barrel is determined by the force equilibrium between propellant and holding pressures. This method leaves the valves vulnerable to influence from O-ring friction, bolt nose side loads, trapped air, and oscillatory propellant and holding pressures. The valves do not repeat the same displacement-time history from injection-to-injection, thereby resulting in non-reproducible propellant mixing. Control of all variables affecting internal ballistics is important if consistant results are to be obtained.

SUMMARY OF THE INVENTION

The invention comprises an improved bi-propellant injection system for liquid propellant guns wherein the displacement of the valves is accomplished through a positive actuation system. The liquid propellant gun comprises a receiver block having a central cavity therein which houses a valve having a forward nose portion which seats against a manifold in fluid communication with the chamber of a gun barrel. The barrel is affixed to the receiver block. Surrounding the valve is an injector piston which is adapted to move axially with respect to the valve and the receiver block. Oxidizer and fuel receiving receptacles are provided within the receiver block and are in communication with the injector piston.

A positive stop is provided rearwardly of the injector piston in the receiver block as well as a positive stop in the receiver block to limit rearward travel of the valve upon opening. Injection of the fuel and oxidizer into the gun barrel chamber is attained when a source of hydraulic fluid under high pressure acts on the injector piston relative to the valve thereby forcing the injector piston forwardly toward the gun chamber and the valve rearwardly against the stop in the receiver block.

In the improved system of the invention the valve is positively opened at the start of the injection cycle and held at a predetermined displacement. This produces a constant size propellant orifice throughout most of the injection cycle.

DESCRIPTION OF THE PREFERRED EMBODIMENT

Figure 1:
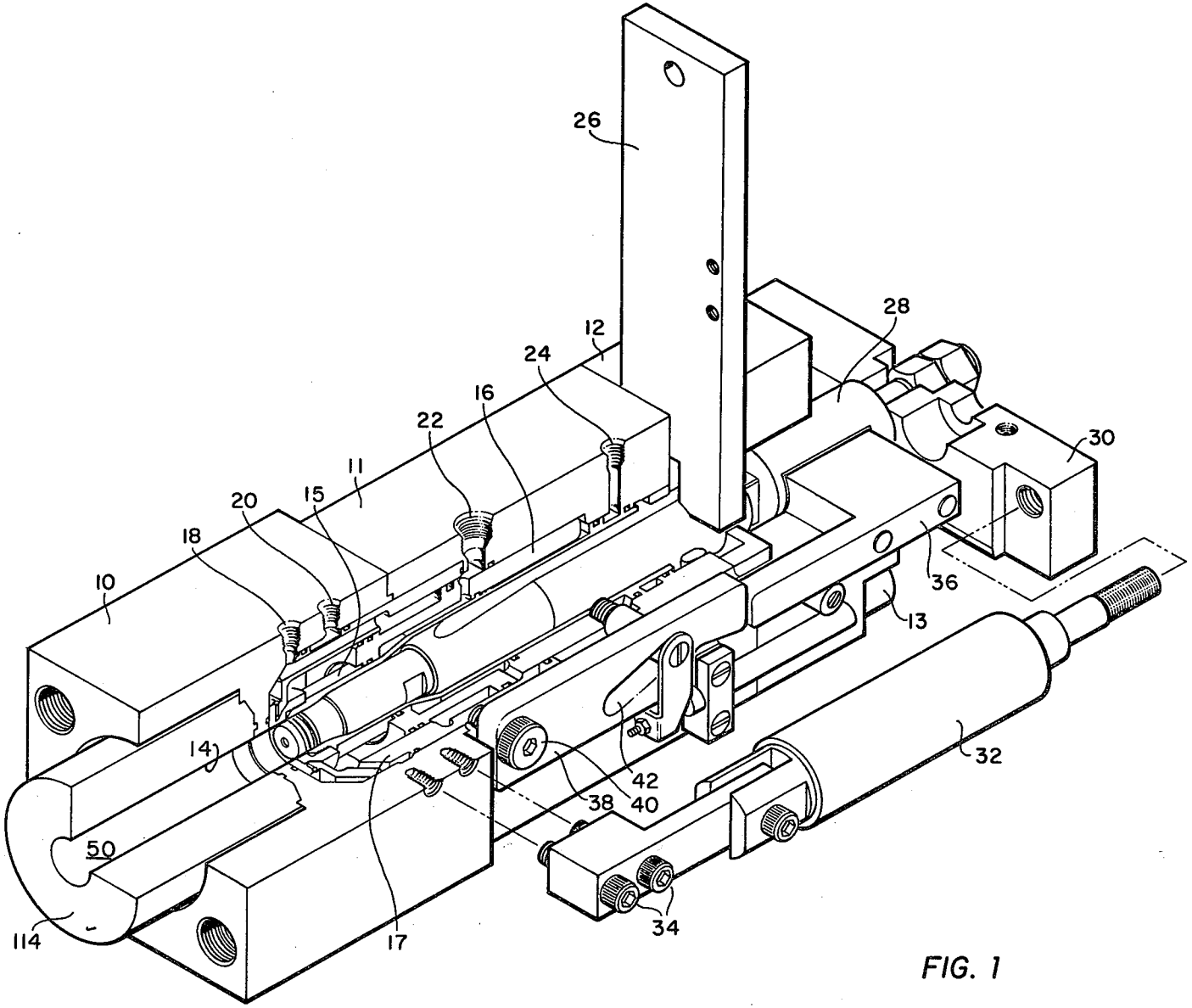
FIG. 1 is an isometric view, partly cut away, of a liquid propellant gun.

With respect to FIG. 1, in the present configuration the injector is housed within two large blocks 10 and 11 formed of suitable material such as stainless steel. A receiver block 12 attaches to the rear of block 11 and four long stringer bolts, one of which is shown at 13, hold blocks 10, 11 and 13 together.

A gun barrel 114 having a chamber 14 is internally mounted at the forward end of block 10. Rearwardly of chamber 14 is a long slender valve 15. Surrounding valve 15 is an injector piston 16 which is adapted for axial movement relative to the valve 15 in the blocks in which it is housed.

A propellant manifold 17 is also mounted within the cavity in blocks 10 and 11 and surrounds the injector piston 16.

Fuel is introduced to the propellant manifold 17 through inlet 18. Oxidizer is introduced to the manifold 17 through inlet 20. Both inlets 18 and 20 are located in block 10.

A source of high pressure hydraulic fluid is introduced through inlet 22 while a similar source of holding pressure fluid is introduced through inlet 24 both of which are shown in block 11.

Rearwardly of block 11 is a guillotine bolt lock 26 which acts to lock a bolt assembly 28 in the forward position prior to firing. Bolt 28 is mounted for reciprocal movement toward and away from the chamber 14 and the movement is accomplished by means of a yoke 30 affixed to the rear of bolt 28 which is coupled to air cylinders, one of which is shown at 32. Air cylinders 32 are mounted to block 10 by means of screws 34.

A cam follower 36 is also part of bolt assembly 28 and is adapted to bear on and cooperate with a cam 38 which pivots about a shoulder screw 40. Cam 38 is caused to rotate about shoulder screw 40 through the interaction of a cam slot 42 and a jog release pin 44.

Figure 2:
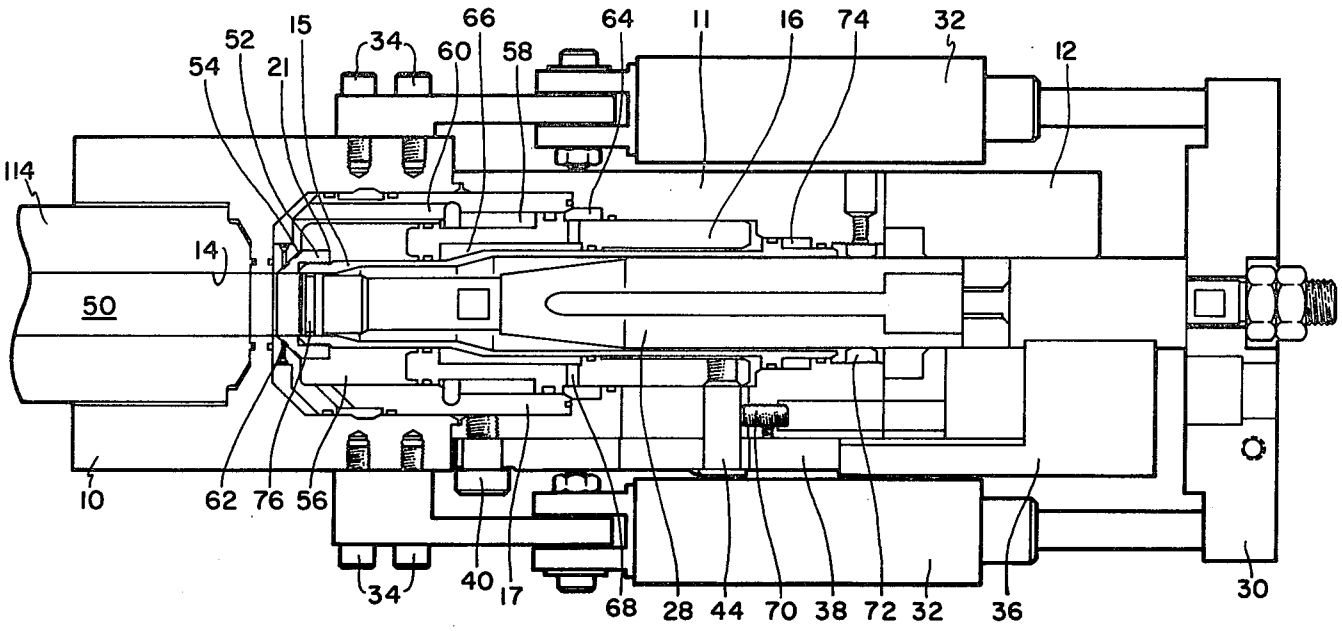
FIG. 2 is a cross-section along the centerline of the embodiment of FIG. 1.

FIG. 2 is a cross-section through the assembly showing the injector system in greater detail. Chamber 14 is shown as having a bore 50. Rearwardly of the chamber 14 and bore 50 is a foreward nose portion 52 on valve 15 which cooperates with a portion 54 on the propellant manifold 17. The rear portion at the nose 52 forms a stop 21.

Propellant manifold 17 is shaped to provide an oxidizer receiving recess 56 and a fuel receiving recess 58 therein. Axial and radial holes 60 and 62, respectively, in the propellant manifold 17 allow introduction of the fuel to the chamber of the gun prior to firing.

Injector piston 16 is shaped to provide hydraulic cavities 64 and 66 between the piston 16 and block 11 and piston 16 and valve 15 respectively. Radial passageways 68 allow fluid communication between the cavities 64 and 66.

Rearward movement of jog release pin 44, and injector piston 16, is limited by a charge/mass adjustment screw 70 while rearward travel of valve 15 is limited by an adjustable valve stop 72 comprising a threaded ring.

Operation of the system will now be described with respect to FIGS. 1 and 2. During the time that the propellant and oxidizer are being loaded into cavities 58 and 56 respectively, the valve 15 is maintained in a closed position by means of holding pressure in a cavity 74. Loading of the fuel and oxidizer forces the injector piston 16 rearwardly until jog release pin 44, contacts the charge/mass adjustment screw 70. This measures the charge of propellant to be injected. Pressure in cavity 74 holds the valve 15 closed during the filling process. During this time, the bolt assembly 28 is ordinarily moved rearwardly out of the interior of the valve 15 by means of the air cylinders 32.

Once the fuel and oxidizer have been introduced into their respective cavities, a projectile and the bolt assembly 28 are inserted into the interior of valve 15 and pushed forward until the cam follower 36 contacts the rear surface of cam 38. At this time, the air cylinders 32 exert a constant forward load on the bolt assembly 28 and another air cylinder (not shown) exerts a constant downward load on the bolt through the guillotine bolt lock 26.

Injection of the fuel and oxidizer into chamber 14 begins as high actuation pressure is introduced into cavities 64 and 66. Simultaneously therewith, valve 15 is forced rearwardly against the adjustable valve stop 72 and the injector piston 16 is forced forwardly thereby pumping propellant into the gun bore 50. Oxidizer flows from chamber 56 directly over the valve nose 52 and fuel flows from chamber 58 through the axial holes 60 and then through the radial holes 62 into the bore 50. The projectile is pumped forwardly into the chamber 14 by the propellant pressure.

Near the end of the injection of the fuel and oxidizer into the chamber, the front of the injector piston 16 contacts stop 21 on the valve nose 52 and forces the valve closed. Simultaneously, the cam 38, after rotating upwardly due to the forward motion of the jog pin 44, releases the cam follower 36. That is, cam 38 rotates upwardly around shoulder screw 40 allowing cam follower 36 to pass thereunder.

The entire bolt assembly 28 jogs forward until the cam follower 36 contacts the receiver block 12. This jog travel pushes the projectile, propellant column, and bolt nose breech pressure seal 76 completely into the chamber 14. At this time, the guillotine bolt lock 26 drops down into an opening in bolt assembly thereby locking the bolt into place. Then, an electric spark produced in the face of the bolt nose ignites the propellant causing discharge of the projectile from the gun barrel.

The improvement in the present injector over previous designs is the ability to repeatably control propellant mixing. This is accomplished by having the valve positively opened at the start of injection and held at a predetermined displacement to provide a constant size propellant orifice throughout most of the injection cycle. Also, the radial fuel passages in the propellant manifold fix the size of the fuel orifice at the point where fuel meets oxidizer which is flowing over the face of the valve. The single valve concept eliminates the possibility of two simultaneously operating valves affecting each other and thereby varying the mix.

Other unique features are that the hydraulic pressure which actuates the injector piston also forces the valve open. In addition, a replaceable manifold surrounding the injector piston directs fuel and oxidizer to the injection port. Also, a synchronization mechanism consisting of the cam 38, cam follower 36 and jog pin 44 release the bolt assembly 28 at the end of the injection thereby allowing the bolt to jog forward into the fire position.

An alternate configuration could be to pump fuel to the injection port through axial holes in the single valve rather than through radial holes in the propellant manifold. The design could also be modified to an old style twin valve configuration with one valve for fuel and one valve for oxidizer while retaining the positive valve opening feature.

What is claimed is:

1. An injection system for a liquid propellant gun comprising:

a chamber for receiving propellant and oxidizer liquids;

a receiver connected to said chamber;

a manifold within said receiver and having passages in fluid communication with said chamber;

a valve mounted within said manifold for selective movement between two positions, one position providing fluid communication between said passages in said manifold and said chamber and one position in fluid sealing relation between said passages in said manifold and said chamber;

a piston slidably mounted within said valve and configured relative to said valve to form two recesses therebetween; and actuation means operatively connected to said piston and said manifold for selectively moving said manifold means to said fluid communication position and to move said piston so as to change the dimensions of said two recesses when said valve in said fluid communication with said chamber, whereby the contents of said recesses may be transferred to said chamber.

2. An injection system according to claim 1 wherein the actuation means is hydraulically coupled to said piston.

3. An injection system according to claim 1 further comprising a bolt mounted for reciprocative movement within said receiver.

4. An injection system according to claim 1 including;

oxidizer conduit means in said receiver and in fluid communication with one of said two recesses formed by the relative configuration of said valve and piston for transferring oxidizer thereto; and propellant conduit means in said receiver and in fluid communication with second of said two recesses formed by the relative configuration of said valve and piston for transferring propellant thereto.

5. An injection system according to claim 4 wherein the fluid communication between said oxidizer conduit means, said propellant conduit means and said two recesses is via said manifold.

6. An injection system according to claim 1 further including limit means carried by said receiver for contracting said piston to restrict movement thereof.

7. An injection system according to claim 6 wherein introduction of oxidizer and propellant within said recesses forces said piston against said limit means.

8. An injection system according to claim 7 further including:

oxidizer conduit means in said receiver and in fluid communication with one of said two recesses formed by the relative configuration of said valve and said piston via apertures in said manifold for transferring oxidant therethrough; and propellant conduit means in said receiver and in fluid communication with the other of said two recesses formed by the relative configuration of said valve and said piston via apertures in said manifold for transferring propellant therethrough.

9. An improved bi-propellant injection system for a liquid propellant gun wherein the improvement comprises an arrangement for repeatably controlling propellant mixing, said arrangement including;

a receiver block having a cavity therein;

a gun barrel mounted on said receiver block and having a propellant receiving chamber at one end thereof;

manifold means in said receiver adjacent said chamber and in fluid communication therewith;

valve means mounted rearwardly of said chamber and coaxial therewith and having a forward nose portion adapted to provide a fluid tight seal with respect to said manifold piston means in the cavity in said receiving block and coaxially mounted with respect to said valve means and configured for relative axial movement with respect thereto;

said cavity being formed with fuel and oxidizer receiving portions;

said receiving and oxidizer portions being in fluid communication with said valve means and said piston injector means;

axial travel limiting means mounted in said receiver block rearwardly of said piston injector means and adapted to limit the rearward movement of said piston means;

injection passageways for conveying fuel and oxidizer into said fuel and oxidizer receiving portions;

said fuel and oxidizer forcing said piston means rearwardly against said travel limiting means to thereby precisely control the amount of fuel and oxidizer in said receiving portions; and positive actuating means acting on said piston means and said valve means to cause said valve means to move rearwardly with respect to said piston means to thereby provide a predetermined orifice opening with respect to said manifold.

10. An improved bi-propellant injection system according to claim 9 wherein said positive actuating means includes a hydraulic fluid coupling.

* * * * *